United States Patent [19]

Gasteiger

[11] Patent Number: 4,825,610

[45] Date of Patent: May 2, 1989

[54] ADJUSTABLE DOOR JAMB AND CEILING CHANNEL

[76] Inventor: Otto Gasteiger, Cedar Valley, Ontario, Canada, L0G 1E0

[21] Appl. No.: 175,322

[22] Filed: Mar. 30, 1988

[51] Int. Cl.[4] ..... E04G 25/04; E06B 1/04

[52] U.S. Cl. ..... 52/217; 52/632; 52/243.1; 52/243

[58] Field of Search ..... 52/243.1, 241, 217, 52/205, 211, 217, 243.1, 632

[56] References Cited

U.S. PATENT DOCUMENTS

| | | | |
|---|---|---|---|
| 2,078,620 | 4/1937 | Venzie | 52/243.1 |
| 3,720,026 | 3/1973 | Gasteiger | 52/241 |
| 3,897,668 | 8/1975 | McDonnell | 52/241 |
| 4,037,380 | 7/1977 | Pollock | 52/243.1 |
| 4,709,517 | 12/1987 | Mitchell et al. | 52/243.1 |

*Primary Examiner*—James L. Ridgill, Jr.

[57] ABSTRACT

A door jamb for a movable wall system provides a downwardly open top channel, a pair of telescoping members attached to the door channel defining the sides of the door opening, and the telescoping members define a shape open away from the door opening to receive the edge of a wall panel. Preferably the top channel has a pair of L shaped members therein defining with the top wall of the channel on inner channel which receives coiled springs to bias a panel downwardly.

18 Claims, 6 Drawing Sheets

FIG.5.
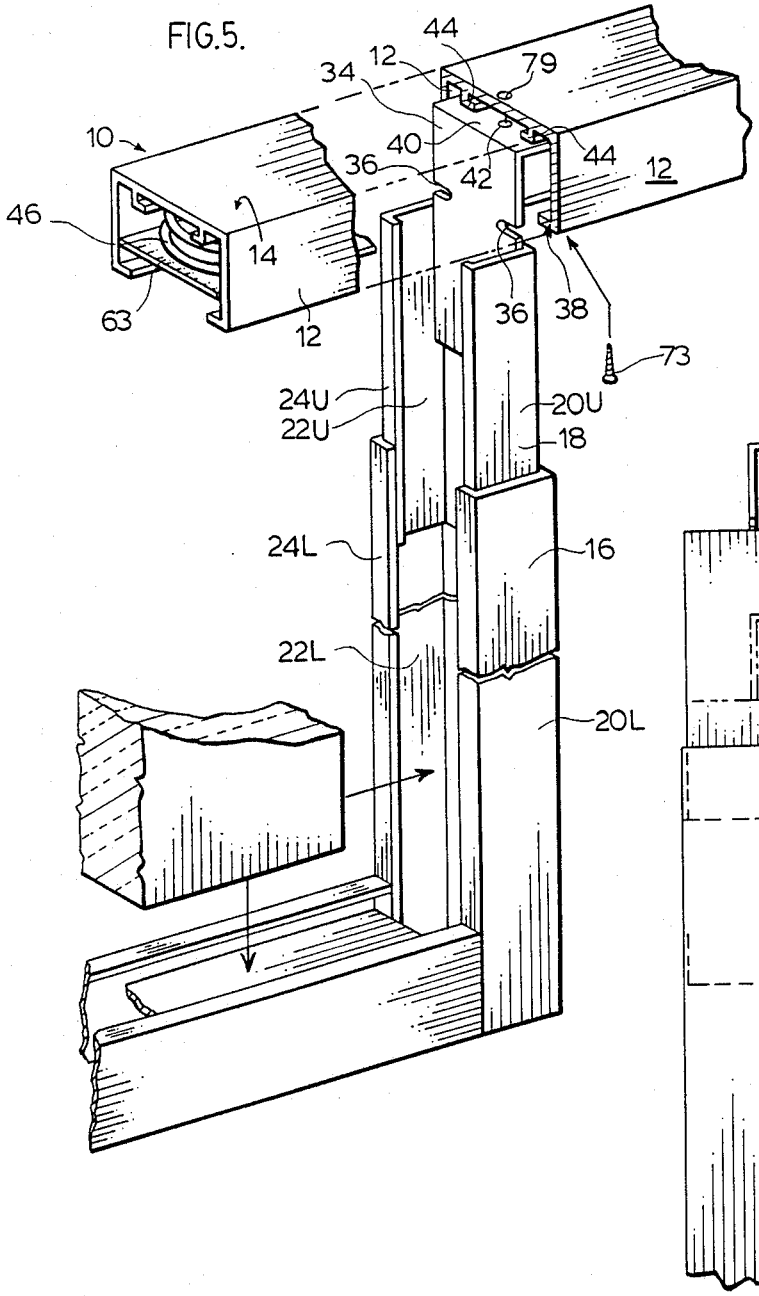
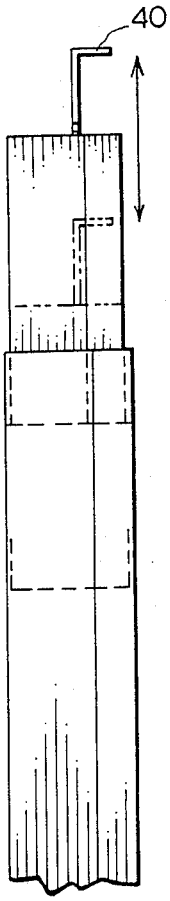
FIG.6.

FIG.9.
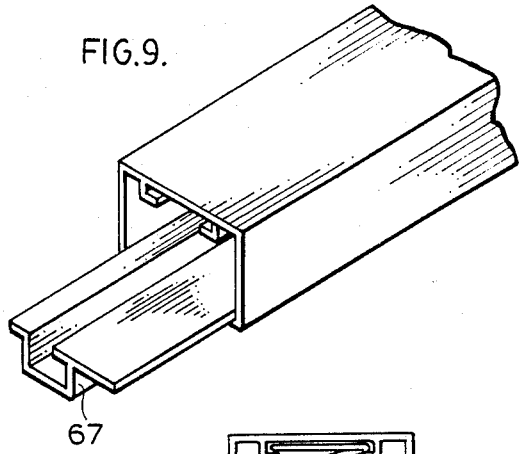
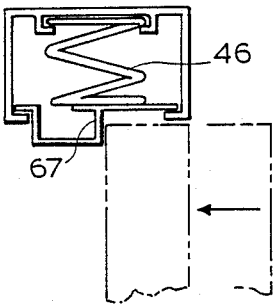
FIG.10.
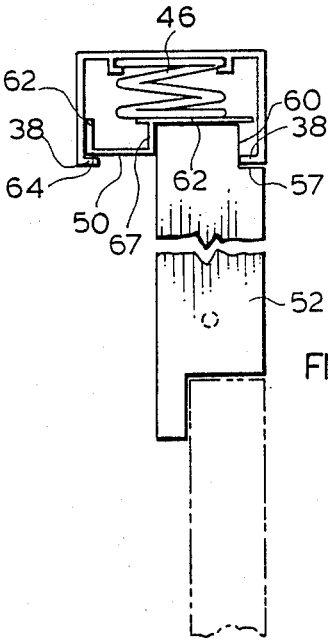
FIG.11.

ADJUSTABLE DOOR JAMB AND CEILING CHANNEL

This invention relates to a door jamb for use with movable partition walls and to a ceiling channel for use with such walls and with the door jamb and its transom.

(By movable partition walls I mean walls which may be moved from one location to another within a building or installed or removed at a location). Such movable partition walls are shown in my U.S. Pat. No. 3,720,026. The present invention provides a door jamb for use with the walls system of the aforesaid patent, although my movable door jamb is useful with other wall systems also.

The door jamb in accord with the insertion provides opposed pairs of telescoping channel members designed to form the opposite jambs of a door opening and, by virtue of the telescoping feature to conform to vertical openings of varying heights. The vertical door jamb members are provided with means for connection to an overhead or ceiling channel which is preferably part of the wall system of the aforesaid patent. The vertical door jamb members are provided with means to connect to a base surface or floor or to a channel mounted on said floor.

The invention provides a door jamb arrangement which is adaptable to ceilings and openings of various heights and is easily installed or removed and which may conveniently form part of a movable wall system of the type shown in my patent.

The ceiling channel in accord with the invention provides a downwardly open channel designed to receive a wall panel or transom and provides means for mounting compression springs inside the channel which bias a plate downwardly to hold the panel or transom under compressive force.

In the drawings which show a preferred embodiment of the invention:

FIG. 5 shows attachments to the telescoping members;

FIG. 6 shows a side view of the telescoping members;

FIG. 9 shows an alternate arrangement with the ceiling channel;

FIG. 10 shows the connection to the components of FIG. 9; and

FIG. 11 shows an alternative door connection using a transom,

Figure 1:
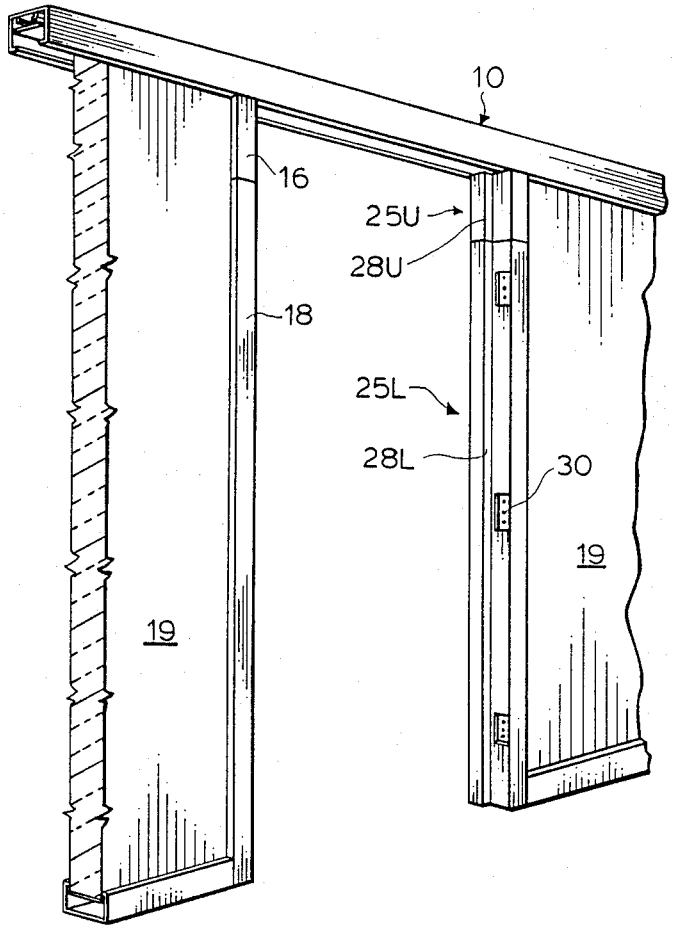
FIG. 1 shows door jamb in accord with the invention.
Figure 2:
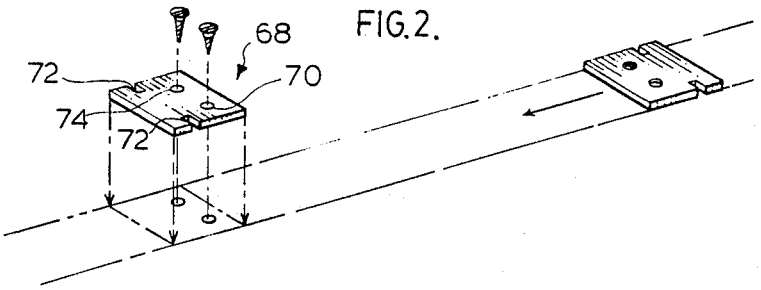
FIG. 2 shows the base attachment means.
Figures 3, 4:
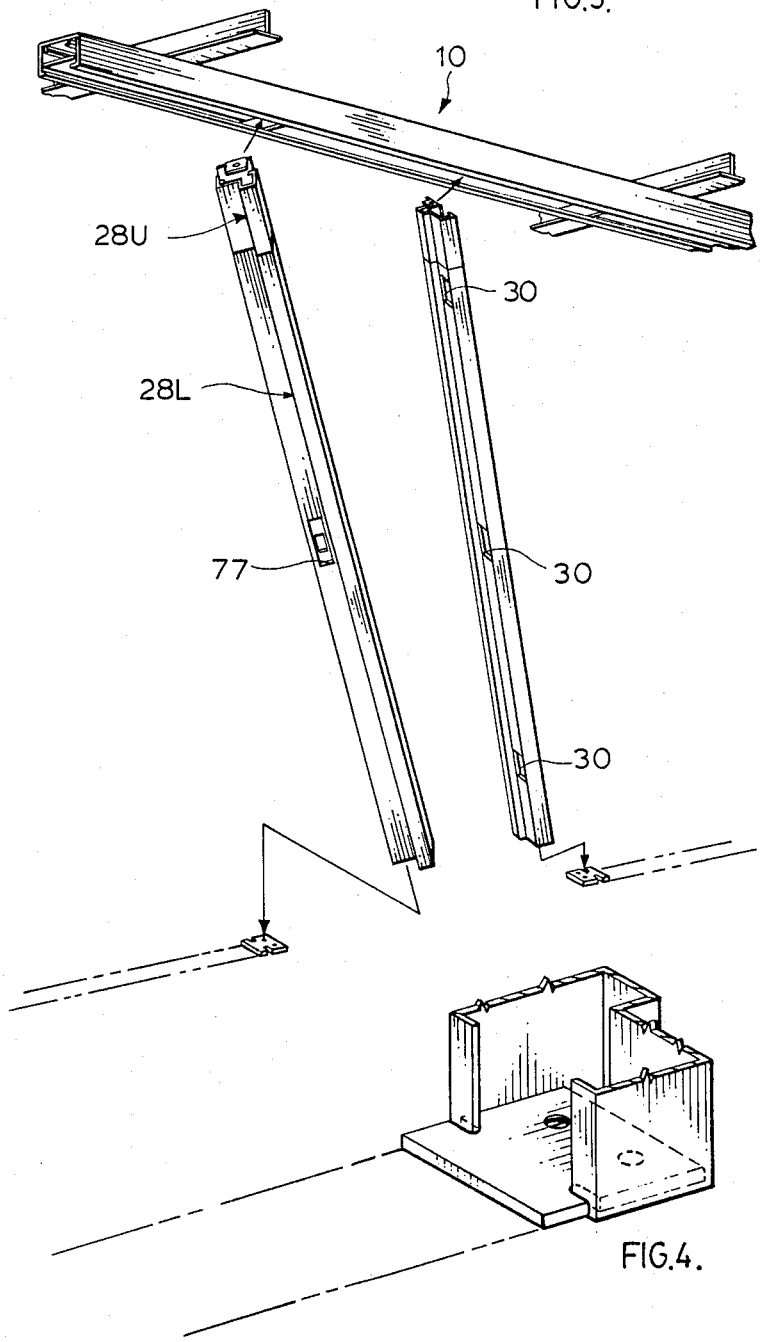
FIG. 3 shows the mode of installation of the telescoping members.
FIG. 4 shows the base attachment.
Figure 7:
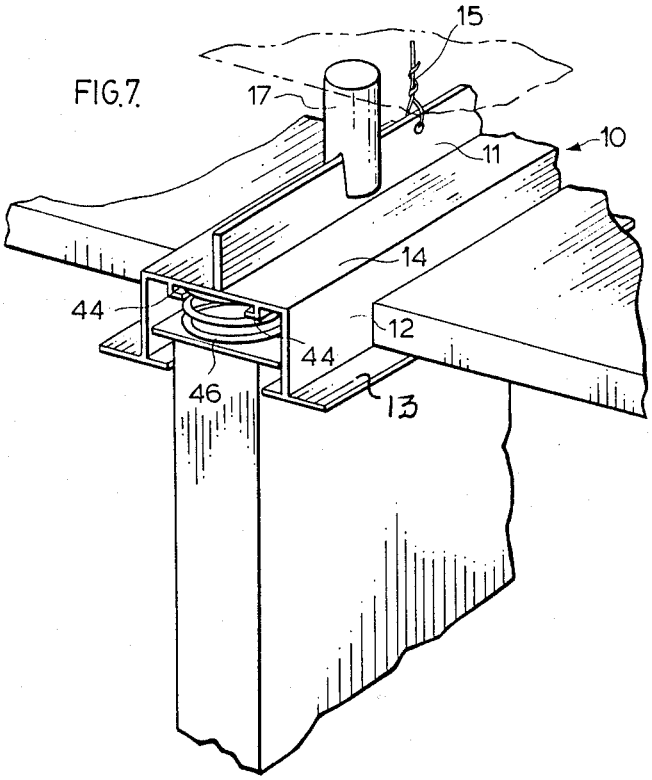
FIG. 7 shows the ceiling channel support.

In the drawings 10 shows a ceiling channel of the types used in my aforesaid patent with one modification as hereinafter discussed. Such ceiling channel 10 may be attached to the ceiling by a number of conventional means including the T - bar shown in FIG. 3 where T - bar is shown extending transverse to the channel 10. (In FIG. 7 a channel 10 is shown with added upstanding spine 11 for attachment to the solid ceiling deck by wire 15. Since the invention involves upward bias on ceiling channel 10 there is therefore provided a compression member 17 schematically shown between the channel 10 and the ceiling deck to prevent upward movement of the channel 10. This version carries side flanges 13 to carry the ceiling panels.) FIG. 3 and the remaining figures show a channel 10 without side flanges since in the main version, as shown in FIG. 7 the T - bar will commonly be suspended by a wire (not shown) but similar to wire 15 and will bear on a compression member (not shown) but similar to compression member 17. The channel 10 comprises top wall 14 and vertical side walls 12 in rectilinear array defining a downwardly opening channel. It will be understood that the ceiling channel 10 conforms generally to the location of the intended plane of the closed door.

The door jambs of the invention comprise lower outer and upper inner slidably telescoping channel members 16 and 18 designed to be vertically disposed. Each telescoping channel member preferably defines in horizontal section a general rectilinear shape open away from the intended door opening to receive a wall or glazing panel 19. Similar parts on the upper and lower telescoping members bear the same numeral and suffix L or U respectively. The walls 20L, and 22L, 20U and 2U, extend parallel to the plane of the opening and at their free ends in inwardly directed lips 24L or U for connection to a wall or glazing unit, by any conventional means.

The wall 25U, 25L of each of the telescoping channel members facing the opening is shaped and stepped to form an inwardly extending shoulder 28U, 28L facing the closing direction of the door so that the channels in section are mirror images of each other, with the exception of hinge plate depressions 30 on one lower member 16 and cut outs at 33 on the corresponding location in the upper member 18. Thus the depressions 30 receive attached hinge plates and the cut outs 33 allow the upper telescoping member to partially overlap with the lower and slide past the hinge plate depressions. The shoulders 28L on the lower channel 16 opposite the hinge plates will then supply shoulder 28L to form the stop for the door when moving toward closing position. Thus the channel wall facing its counter part holding the hinge may be apertured to receive the door hardware to maintain the door closed or to lock it.

The upper and lower telescoping channel will have their overlap adjusted to fit the floor to ceiling height at the intended door location, and holes may be drilled and bolts inserted to fix the overlap once the correct telescopic overlap has been developed. However this is found unnecessary practice in view of the fact that the upper telescope member 18 is anchored to the ceiling and the lower telescopic member is secured to the floor both as hereinafter described.

At the upper end of each upper channel 24U a connector plate 34 extends upwardly from the upper end of the upper channel member. The plate 34 is designed so that, in use, its plane is perpendicular to the plane of the door opening and to a closed door. The plate 34 is shaped so that its edges slidably meet the inner sides of the vertical walls 12 of the ceiling channel. Thus slots 36 are cut in opposed edges of the plate to slidably receive the inwardly directed lips 38 of the ceiling channel. The plate 34 is a part of the upper telescoping channel member.

At the upper end of the plate a tab 40 is bent to be horizontal when the channels are upright. The tab is apertured at 42 so that the upper end of the upper channel can be fastened to the ceiling or ceiling channel to prevent the movement of the upper end of the telescoping channel in any horizontal directions.

Figure 12:
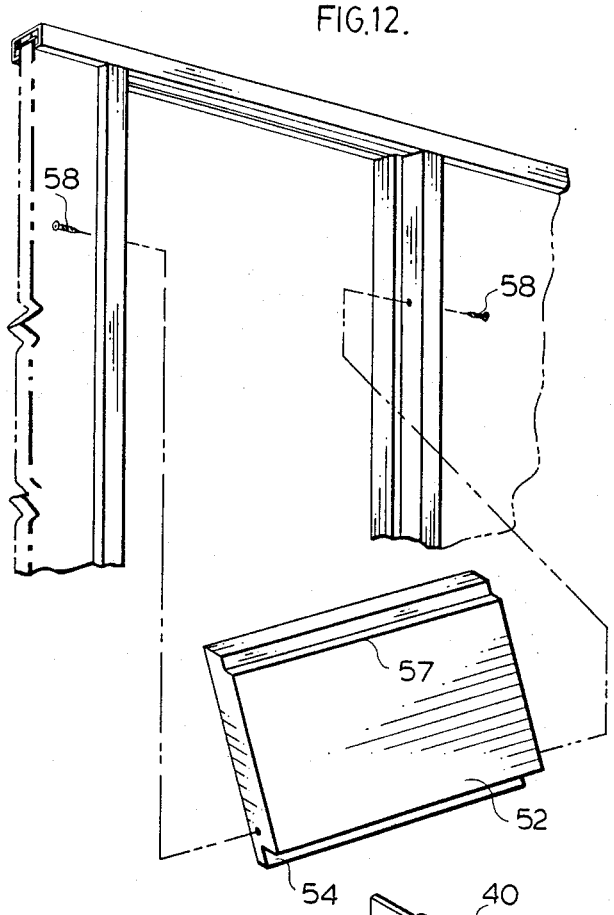
FIG. 12 shows the method of attaching the transom.
Figure 13:
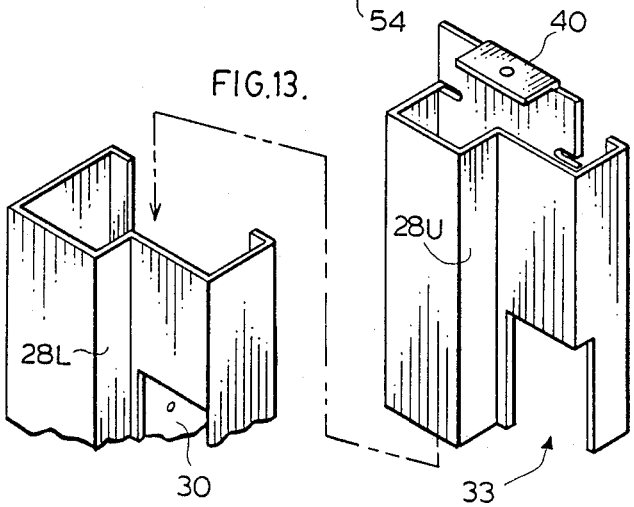
FIG. 13 shows a detail of construction of the upper telescopic member.

The ceiling channel is provided with a small inner channel formed by facing L shaped members 44 depending from the upper wall member between the side walls and having the ends of the L shaped members directed toward one another. The small inner channel is designed to act as an upper retainer for coil springs 46. In position over a wall panel, the coil springs 46 act to press a plate down on the panel and which panel is pressed downwardly against its lower limiting means while the ceiling channel is pressed upwardly against the ceiling. The inner channel allows the coil spring to be held in place between members 44 and the top wall with a helix turn between the lips of the inner channel. Similarly in the portion of the ceiling channel extending over the door frame, and between the upper ends of the telescoping channel coil springs 46 are installed to press downwardly on plate 50 in the alternative where a transom is used. Where a transom 52 is used it is usually of the width of the telescoping member exclusive of the shoulder forming portion it is installed as shown in FIG. 12 to cover the space between the ceiling channel 10 and the door. Lateral attachment of the hollow metal transom member therefore is preferably by self-threading bolts 58 inserted in the telescoping member through holes drilled therein and in the side walls of the transom members.

The lower face of the transom member is preferably stepped to form a stop - shoulder 54 for the closing or closed door which forms a horizontal extension of the similar stop shoulders 28U on the telescoping channel. The upper wall 56 of the transom is shaped to provide a lower step 57 nearer the door opening side and a high step over the remainder of the panel thickness. The lower step is designed to underly the adjacent ceiling channel lip 38 and the 'riser' 60 to the higher step meets the edge of such lip. The ceiling channel plate 50 is shaped to have flat member 62 designed to contact the upper level of the transom and to extend to the ceiling channel vertical wall in the door opening direction. On the opposite side of the transom the top plate is stepped down so that its other end 64 bears on the adjacent lip 38 of the ceiling channel and has an up-turned end 62 to slide on the adjacent vertical wall of the ceiling channel.

If no transom is used, so that the door top, when closed comes immediately below the ceiling channel, the ceiling channel may be closed by a flat plate 63 of the type used over a wall panel and biased down by springs 46 against the lip 38 of the ceiling channel; or by the stepped plate 50 also biased downwardly by the spring and having a shoulder 67 defining the closing limit of door 69 movement.

The bottom plate 68 is shaped to provide a portion 70 to be slidably received within the lower end of the lower telescoping channel and is thus provided with inwardly directed slot 72 designed to receive the lips 24L of the lower telescoping member.

Apertures 74 are provided to allow the bottom plate 68 to be fixed to the floor. The purpose of the bottom plate is to fix the lower telescoping channel 18 against lateral movement when the latter is slid thereover. The bottom plate 68 may be made as thick as desired for this purpose. The channel 18 is fixed against lateral movement by being slid vertically over the bottom plate portion 70 and removed by movement upwardly therefrom, taking advantage of the telescopic adjustments between telescoping channels 16 and 18.

Thus the door frame assembly is firmly fixed in place as follows. Each set of telescoping channel members 16 and 18 may be somewhat contracted and the two members turned (see FIG. 3) so that the upper plate 34 is inserted between the lips 38 of the ceiling channel received in the slots 36 of the plate. The tab 40 rests below the inner channel on the ceiling member and is (with the upper and lower telescoping member) fixed against lateral movement, by being attached to the ceiling channel with a screw 73 through aperture 42. The lower end of the lower telescoping channel is slid over the bottom plate portion 70. It will be seen that the door frame members are now firmly fixed in place. Between the locations of the telescoping members the coil springs 46 are fixed in place in the ceiling channel and the plate 50 on the one hand or plate 63 on the other hand (depending on whether a transom is used or not) is fixed in place for downward bias by the springs 46, the plate being tilted for insertion above the lips and pressed into position against the pressure of the coil springs.

If a transom is used it is then installed by drilled holes and self tapping bolts as described.

Any necessary door hardware or striker plate openings 77 are then provided on the lower telescoping member opposite the hinge side of the door. As previously described, the hinge side lower telescopic member is provided with depressions 30 for hinge plates attached to these locations.

When it is desired to remove the door or to move the whole wall the above procedure may be reversed.

Figure 8:
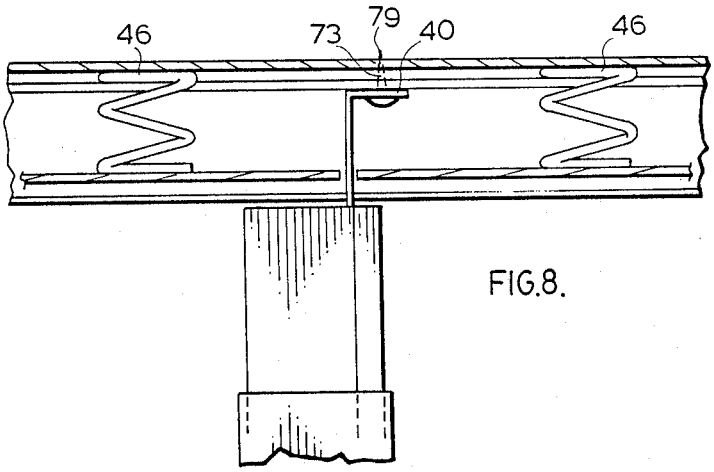
FIG. 8 shows a side view partially in section between the telescoping member and the ceiling channel.

In the embodiment shown, the tab 40 on the upper plate is dimensioned to be used below and not between the L-shaped members 44 of the small inner channel on the ceiling channel. However, if desired, the tab 40 and its attachment may be dimensioned so that it may be inserted between the lips 44 of the small channel when the channel is turned sideways to place its upper plate 34 inside the ceiling channel and tab 40 and its connection would then be dimensioned so that when the plate is turned to be perpendicular to the ceiling channel the lips 44 of the small channel are received in a clearance between the tab and the upper plate. With the tab thus in place the screw 73 may be inserted through aperture 42 to fix the telescoping members against lateral movement. As shown in FIG. 5 and 8 the ceiling channel may be drilled at 79 to allow passage of screw 73 is desired.

I claim:

1. Door jamb for movable wall system having a downwardly open top channel substantially overlying the location of a closed door mounted on a jamb, and a base surface is provided below said location, an extension assembly corresponding to each side of the door jamb, each assembly comprising upper and lower telescoping channels, said upper telescoping member including means for attachment to said top channel, means for connecting said lower telescoping member to a member on said base surface, each of said upper and lower telescoping channels defining in horizontal section a shape open in the direction away from the door opening to receive the side edge of a wall or glazing panel.

2. Door jamb, as claimed in claim 1 wherein said downwardly open channel has a top wall and opposed side walls substantially perpendicular thereto, extending downwardly therefrom, and opposed lips extending inwardly from the bottom of said side walls, a connection plate extending upwardly from said upper telescoping member, oriented to have its plane perpendicular to the longitudinally extending direction of said channel, the upper end of said connection plate having opposed side edges arranged to make sliding contact with said side walls when so oriented, and horizontal slots extending into said so plate edges, dimensioned to receive said opposed lips when said plate is so oriented.

3. Door jamb as claimed in claim 1 wherein at least one set of said telescoping members, on the side facing the door opening, is formed, intermediate the thickness measured in the door closing direction, with a shoulder surface projecting into the door opening and facing the door closing direction.

4. Door jamb as claimed in claim 1 wherein the downwardly open top channel acts as a door transom embodied by a plate which is biassed downwardly by means of a coil spring.

5. Door jamb as claimed in claim 1 wherein said downwardly open channel has top wall, sidewalls extending downwardly therefrom to define three sides of a rectangle in transverse section, and lips extending inwardly from the bottom of said side walls, a rigid connection plate extending upwardly from said upper telescoping member, said connection plate being contoured to be slidably received within said top channel when oriented transverse to the longitudinal direction thereof and having slots to accommodate said lips.

6. Door jamb as claimed in claim 5 wherein at least one set of said telescoping members, on the side facing the door opening, is formed, intermediate the thickness measured in the door closing direction, with a shoulder surface projecting into the door opening a facing the door closing direction.

7. Door jamb as claimed in claim 5 wherein said connection plate has an upper extremity having a top tab, extending horizontally, there being means for securing said top tab against movement traverse to the longitudinal axis of the telescopic member.

8. Door jamb as claimed in claim 7 wherein at least one set of said telescoping members, on the side facing the door opening, is formed, intermediate the thickness measured in the door closing direction, with a shoulder surface projecting into the door opening and facing the door closing direction.

9. Door jamb as claimed in claim 7 wherein said top tab securing means is designed to be secured by a single screw.

10. Door jamb as claimed in claim 1 wherein said base surface connection means allows upward and downward movement of said lower telescopic member for connection and disconnection respectively from a base surface and for preventing movement of said member in other directions when connected, 11. Door jamb, as claimed in claim 10 wherein said downwardly open channel has a top wall and opposed side walls substantially perpendicular thereto, extending downwardly therefrom, and opposed lips extending inwardly from the bottom of said side walls, A connection plate extending upwardly from said upper telescoping member, oriented to have its plane perpendicular to the longitudinally extending direction of said channel, the upper end of said connection plate having opposed side edges arranged to make sliding contact with said side walls when so oriented, and horizontal slots extending into said so plate edges, dimensioned to receive said opposed lips when said plate is so oriented.

12. Door jamb as claimed in claim 10 wherein at least one set of said telescoping members, on the side facing the door opening, is formed, intermediate the thickness measured in the door closing direction, with a shoulder surface projecting into the door opening and facing the door closing direction.

13. Door jamb for movable wall system, comprising:

an extension assembly corresponding to each side of said door jamb, each assembly comprising upper and lower telescoping channels, said upper telescoping member including means for attaching said member to the ceiling, said lower telescoping member including means for fixing the lower end of said lower telescoping member against lateral movement relative to the base surface, each of said upper and lower telescoping channels defining in horizontal section a shape open in the direction away from the door opening to receive the side edge of a wall or glazing panel.

14. Door jamb as claimed in claim 13 wherein said fixing means allows upward and downward movement of said lower telescopic member for connection and disconnection from a base surface and for preventing movement of the lower end of said lower telescopic member when attached.

15. Door jamb, as claimed in claim 13 wherein at least one set of said telescoping members, on the side facing the the door opening, is formed, intermediate the thickness measured in the door closing direction, with a shoulder surface projecting into the door opening and facing the door closing direction.

16. Door jamb as claimed in Claim 13 wherein at least one set of said telescoping members, on the side facing the door opening, is formed, intermediate the thickness measured in the door closing direction, with a shoulder surface projecting into the door opening and facing the door closing direction.

17. Ceiling channel including longitudinally extending top and side walls and defining a longitudinally extending downwardly opening channel, said channel defining a small inner channel extending the length of the ceiling channel comprised of L-shaped members depending from the top wall directed toward one another designed to retain the upper helix turn of a coil spring, coil springs so retained, a plate mounted in said channel and designed to be biassed downwardly by said coiled springs to bear on the upper edge of a vertical wall panel.

18. Ceiling Channel including longitudinally extending top and side walls and defining a longitudinally extending downwardly opening channel, said channel being designed to contain longitudinally extending means to which a coil spring with a vertical axis may be detachably attached and suspended, at selected locations along said longitudinally extending channel, coil springs so attached, a plate mounted in said channel and designed to be biassed downwardly by said coil springs to bear on the upper edge of a vertical wall panel.

* * * * *